US009454936B2

(12) United States Patent
Kang et al.

(10) Patent No.: US 9,454,936 B2
(45) Date of Patent: Sep. 27, 2016

(54) DISPLAY APPARATUS

(71) Applicant: Samsung Display Co., Ltd., Yongin, Gyeonggi-Do (KR)

(72) Inventors: Jong Hyuk Kang, Suwon-si (KR); Jae Byung Park, Seoul (KR); Junghyun Kwon, Seoul (KR); Sungtae Shin, Suwon-si (KR); Dong-Hoon Lee, Hwaseong-si (KR); Hyundeok Im, Seoul (KR); Hyun Min Cho, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 88 days.

(21) Appl. No.: 13/975,154

(22) Filed: Aug. 23, 2013

(65) Prior Publication Data

US 2014/0268634 A1 Sep. 18, 2014

(30) Foreign Application Priority Data

Mar. 12, 2013 (KR) ..... 10-2013-0026339

(51) Int. Cl.

| | |
|---|---|
| ***F21V 9/00*** | (2015.01) |
| ***G09G 3/34*** | (2006.01) |
| ***G09G 3/20*** | (2006.01) |

(52) U.S. Cl.

CPC ..... *G09G 3/3406* (2013.01); *G09G 3/2025* (2013.01); *G09G 2300/0452* (2013.01); *G09G 2300/0456* (2013.01)

(58) Field of Classification Search

CPC .. G09G 3/342; G09G 3/3607; G09G 3/2003; G02F 1/13624; G02F 1/13306

See application file for complete search history.

(56) References Cited

U.S. PATENT DOCUMENTS

| | | | | |
|---|---|---|---|---|
| 6,592,780 | B2 | 7/2003 | Hohn et al. | |
| 7,832,895 | B2 | 11/2010 | Sumitani et al. | |
| 2008/0191605 | A1* | 8/2008 | Lin et al. | 313/501 |
| 2011/0121319 | A1 | 5/2011 | Haase et al. | |
| 2011/0157916 | A1 | 6/2011 | Lee et al. | |
| 2014/0098144 | A1* | 4/2014 | Shin | G09G 3/2003 345/694 |

FOREIGN PATENT DOCUMENTS

| | | |
|---|---|---|
| JP | 4424297 | 12/2009 |
| JP | 5005712 | 6/2012 |
| KR | 10-2011-0035114 | 4/2011 |
| KR | 10-2011-0078150 | 7/2011 |
| KR | 10-2013-0126396 | 11/2013 |

* cited by examiner

*Primary Examiner* — Andrew Coughlin
(74) *Attorney, Agent, or Firm* — Innovation Counsel LLP

(57) ABSTRACT

A display apparatus is provided. The display apparatus includes a first light source unit comprising a first light source that emits light having a first spectral band and a photo-converter that converts the light having the first spectral band to a first color light. A spectral band of the first color light is different from the first spectral band of the light emitted from the first light source. The display apparatus also includes a second light source unit comprising a second light source that emits light having a second spectral band. The light having the second spectral band corresponds to a second color light, and has a same color as the light having the first spectral band. A spectral band of the second color light is different from the spectral band of the first color light.

10 Claims, 11 Drawing Sheets

< 2-Field >

< 2-Field >

DISPLAY APPARATUS

CROSS-REFERENCE TO RELATED APPLICATION

This U.S. non-provisional patent application claims priority under 35 U.S.C. §119 to Korean Patent Application No. 10-2013-0026339 filed on Mar. 12, 2013, the contents of which are hereby incorporated by reference in its entirety.

BACKGROUND

1. Field of Disclosure

The present disclosure relates to a display apparatus. More particularly, the present disclosure relates to a display apparatus having improved display quality and response speed.

2. Description of the Related Art

In general, a display apparatus can realize a full color image using a space division scheme or a time division scheme. In the space division scheme, a display panel includes red, green, and blue color filters repeatedly arranged to correspond to sub-pixels in a one-to-one correspondence. A combination of a red, green, and blue color filter constitutes a unit for realizing a color. A full color image is then realized based on a transmittance difference between the sub-pixels of the display panel and the color combinations of the red, green, and blue color filters.

The time division scheme (or a field sequential scheme) can be used to realize a full color image with high transmittance at low manufacturing cost. In the time division scheme, the color filters are omitted from the display panel. Instead, a backlight unit is disposed at a rear side of the display panel and the backlight unit includes red, green, and blue light sources respectively emitting red, green, and blue color lights. In addition, a frame is divided into three time-divisional fields. The red, green, and blue light sources provide light in each field, thereby sequentially displaying red, green, and blue color images. Accordingly, an observer perceives the full color image formed by the visual combination of the red, green, and blue color images.

Although the time division scheme enables high transmittance of full color images at low manufacturing cost, the time division scheme is subject to a phenomenon known as color breakup, which momentarily occurs when an observer's viewpoint changes due to motion of the eye or body. Specifically, the color breakup distorts the observer's perception of the full color image, by causing the observer to separately perceive individual red, green, and blue color images.

SUMMARY

The present disclosure is directed to address at least the above problems relating to color breakup in a display apparatus.

According to some embodiments of the inventive concept, a display apparatus is provided. The display apparatus includes a display panel including a plurality of pixels, a first light source unit disposed at a rear surface of the display panel to provide a first color light to the display panel, and a second light source unit disposed at the rear surface of the display panel to provide a second color light to the display panel, wherein the first light source unit comprises a first light source that emits light having a first spectral band and a photo-converter that converts the light having the first spectral band to the first color light, and a spectral band of the first color light is different from the first spectral band of the light, and wherein the second light source unit comprises a second light source that emits light having a second spectral band, the light having the second spectral band corresponds to the second color light, and a spectral band of the second color light is different from the spectral band of the first color light.

In some embodiments, the second color light may include a blue color light.

In some embodiments, the first spectral band of the light emitted from the first light source may be of a shorter wavelength than the second spectral band of the light emitted from the second light source.

In some embodiments, the first spectral band of the light emitted from the first light source may range from about 435 nanometers to about 447 nanometers, and the second spectral band of the light emitted from the second light source may range from about 448 nanometers to about 460 nanometers.

In some embodiments, each of the pixels may include a first color filter, a second color filter having a color different from the first color filter, and an open portion in which the first and second color filters are not disposed.

In some embodiments, the display panel may display an image in a unit of frame, and the first and second light source units may respectively provide the first and second color lights to the display panel during first and second sub-fields obtained by dividing the frame according to a time sequence.

In some embodiments, each of the pixels may include first, second, and third sub-pixels respectively corresponding to the first color filter, second color filter, and open portion, and wherein the first, second, and third sub-pixels are independently driven.

In some embodiments, the first, second, and third sub-pixels may receive the first color light during the first sub-field to display the image, and the third sub-pixel may receive the first color light during the second sub-field to display a blue image.

In some embodiments, the first color light may include a yellow color light, and the first and second color filters may respectively comprise a red color filter and a green color filter.

In some embodiments, the photo-converter may include a phosphor or a quantum dot to absorb the light from the first light source and emit the first color light.

In some embodiments, the photo-converter may receive the light from the first light source and emit a light having a yellow color spectral band.

In some embodiments, the photo-converter may receive the light from the first light source and emit a light having a red color spectral band and a light having a green color spectral band.

BRIEF DESCRIPTION OF THE DRAWINGS

The above and other advantages of the present disclosure will be readily apparent with reference to the following detailed description and accompanying drawings.

DETAILED DESCRIPTION

Figure 1:
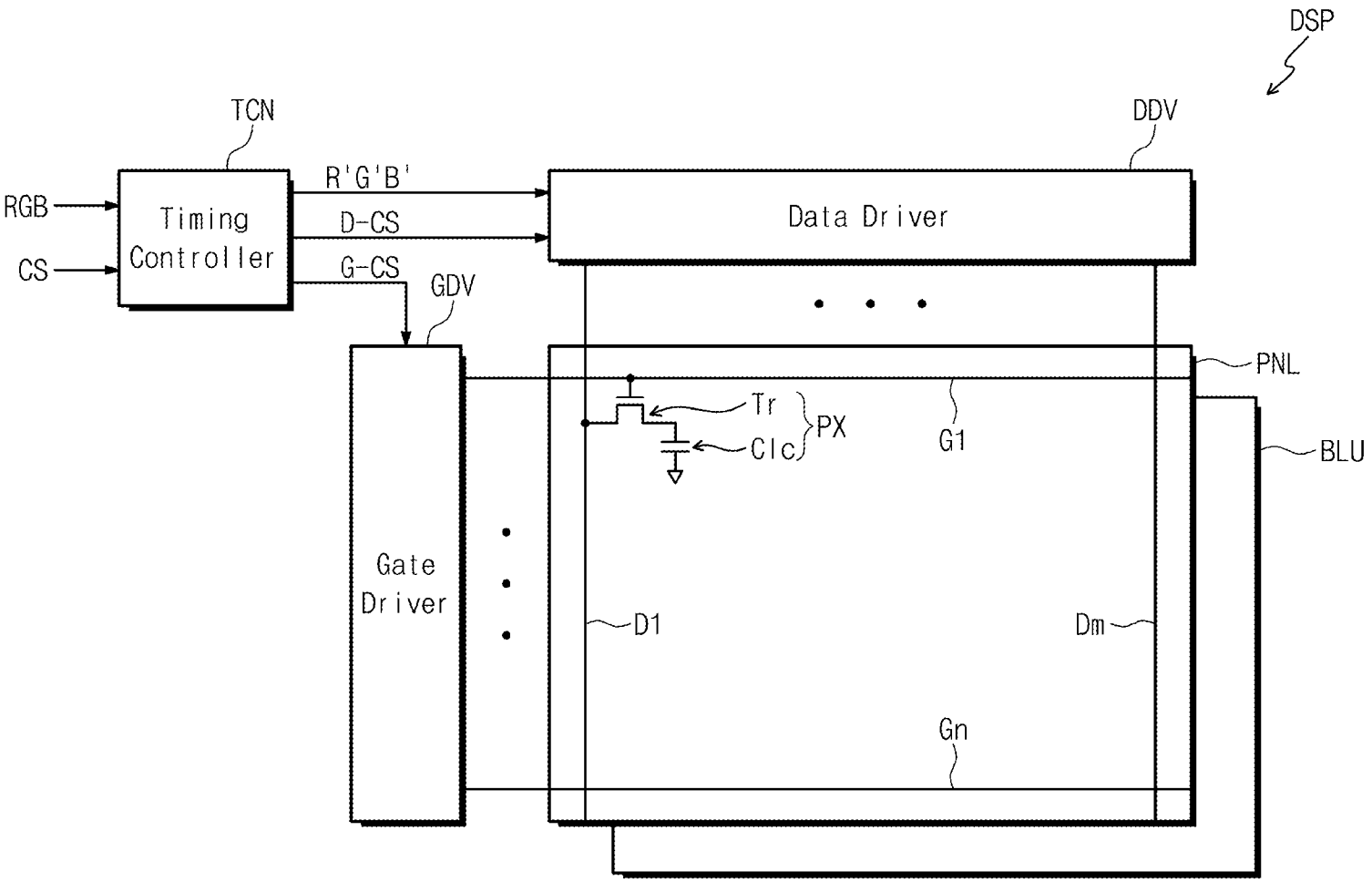
FIG. 1 is a block diagram showing a display apparatus according to an exemplary embodiment of the present disclosure.

It will be understood that when an element or layer is described as being "on", "connected to", or "coupled to" another element or layer, the element or layer can be disposed directly on, connected or coupled to the other element or layer, with or without any intervening elements or layers. In contrast, when an element is described as being "directly on," "directly connected to", or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by the terms. The terms are used to distinguish one element, component, region, layer or section from another region, layer, or section. Thus, a first element, component, region, layer, or section (described herein) could be renamed as a second element, component, region, layer, or section without departing from the teachings of the present disclosure.

Spatially relative terms, such as "beneath", "below", "lower", "above", "upper" and the like, may be used herein to describe an element or feature's spatial relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an "above" and/or "below" orientation. The device may also be oriented (rotated 90 degrees or at other orientations) and the spatially relative descriptors used herein should be interpreted accordingly.

The terminology used herein is for the purpose of describing certain embodiments and is not intended to limit the scope of the present disclosure. As used herein, the singular forms, "a", "an", and "the" include the plural forms as well, unless the context clearly expresses otherwise. It will be further understood that the terms "includes" and/or "including", as used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and should not be interpreted in an idealized or overly formal sense unless otherwise expressly defined.

Hereinafter, the present inventive concept will be explained in detail with reference to the accompanying drawings.

FIG. 1 is a block diagram showing a display apparatus according to an exemplary embodiment of the present disclosure.

Referring to FIG. 1, a display apparatus DSP includes a display panel PNL to display an image, gate driver GDV and data driver DDV to drive the display panel PNL, and a timing controller TCN to control the driving of the gate and data drivers GDV and DDV.

The display panel PNL includes a transmissive display such as a liquid crystal display panel. In some other embodiments, the display panel PNL may include an electrophoretic display panel, an electrowetting display panel, or a micro-electro-mechanical system (MEMS) display panel.

The display panel PNL includes a plurality of gate lines G1 to Gn, a plurality of data lines D1 to Dm, and a plurality of pixels PX. The gate lines G1 to Gn extend in a row direction and are arranged in a column direction substantially parallel to each other. The data lines D1 to Dm extend in the column direction and are arranged in the row direction substantially parallel to each other.

Each pixel PX includes a thin film transistor and a liquid crystal capacitor. For instance, a pixel PX (that is connected to a first gate line G1 and a first data line D1) includes the thin film transistor Tr and the liquid crystal capacitor C1c.

The thin film transistor Tr includes a gate electrode connected to the first gate line G1, a source electrode connected to the first data line D1, and a drain electrode connected to the liquid crystal capacitor C1c.

The timing controller TCN receives image signals RGB and control signals CS from a source outside of the display apparatus DSP. The timing controller TCN converts a data format of the image signal RGB into a format that is compatible with an interface between the data driver DDV and the timing controller TCN, and applies the converted image signals R'G'B' to the data driver DDV. In addition, the timing controller TCN generates a data control signal D-CS (e.g., an output start signal, a horizontal start signal, etc.) and a gate control signal G-CS (e.g., a vertical start signal, a vertical clock signal, a vertical clock bar signal, etc.) based on the control signals CS. The data control signal D-CS is then applied to the data driver DDV and the gate control signal G-CS applied to the gate driver GDV.

The gate driver GDV sequentially outputs gate signals in response to the gate control signal G-CS provided from the timing controller TCN. Accordingly, the pixels PX are sequentially scanned by the gate signals row by row.

The data driver DDV converts the image signals R'G'B' to data voltages in response to the data control signal D-CS. The data voltages are then applied to the display panel PNL.

Subsequently, each pixel PX is turned on by the gate signal, and the turned-on pixel PX displays an image having a desired gray scale using a corresponding data voltage provided from the data driver DDV.

As shown in FIG. 1, the display apparatus DSP further includes a backlight unit BLU disposed at a rear side of the display panel PNL. The backlight unit BLU provides light to the display panel PNL at the rear side of the display panel PNL.

In some embodiments, the backlight unit BLU may include a plurality of light emitting diodes (not shown) as its light source. The light emitting diodes may be disposed on a printed circuit board in a stripe form or a matrix form.

Figure 2:
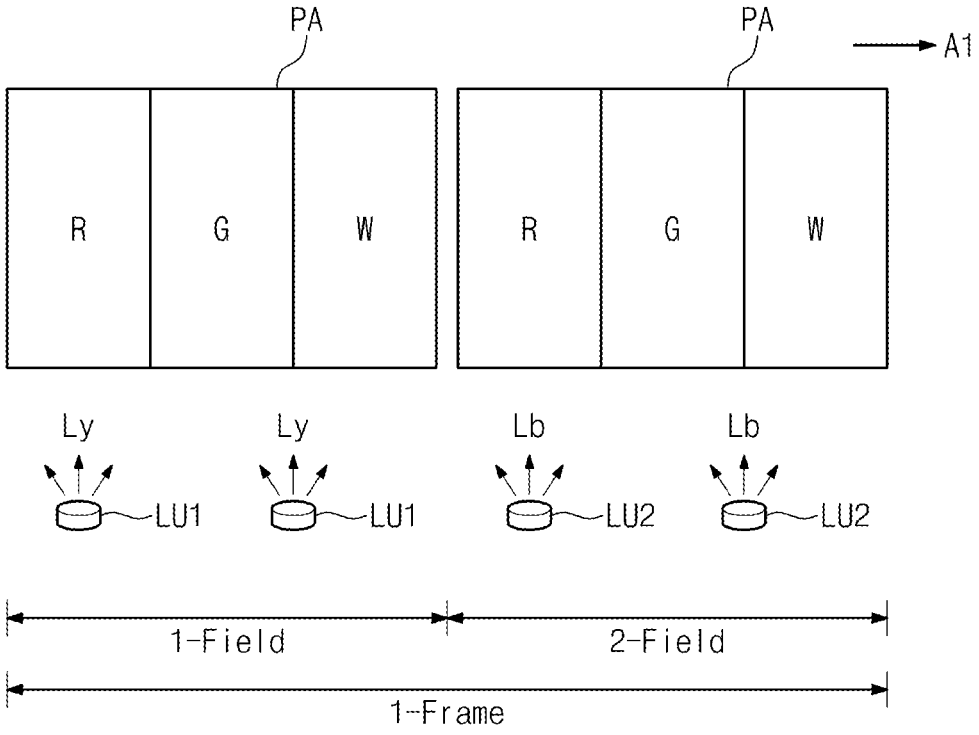
FIG. 2 illustrates an exemplary realization of a full color image using time and space division schemes.

FIG. 2 illustrates an exemplary realization of a full color image using time and space division schemes.

Referring to FIG. 2, the time and space division schemes are applied to the display panel PNL of FIG. 1. The display panel PNL includes first and second color filters having different colors from each other. For example, the first color filter may include a red color filter R to produce a red color and the second color filter may include a green color filter G to produce a green color. An area corresponding to a pixel is referred to as a pixel area PA, and each pixel area PA includes the red and green color filters R and G. In addition, each pixel area PA includes an open portion W which does not have a color filter. The open portion W is disposed adjacent to a side of one of the red and green color filters R and G. Although FIG. 2 depicts the red color filter R, green color filter G, and open portion W being arranged in a direction A1, the arrangement of the color filters R and G and open portion W need not be limited to the direction A1. For example, in some other embodiments, the color filters R and G and open portion W may be arranged in other directions.

As mentioned above, the time and space division schemes are applied to the display panel PNL of FIG. 1 which includes the backlight unit BLU. Referring to FIG. 2, the backlight unit BLU includes a first light source LU1 emitting a first color light Ly and a second light source LU2 emitting a second color light Lb. A frame 1-Frame is divided into two sub-fields (a first sub-field 1-Field and a second sub-field 2-Field) according to a time sequence. In the first sub-field 1-Field, the first light source LU1 is driven to emit the first color light Ly which exits from the backlight unit BLU, thereby supplying the first color light Ly to the display panel PNL. In the second sub-field 2-Field, the second light source LU2 is driven to emit the second color light Lb which exits from the backlight unit BLU, thereby supplying the second color light Lb to the display panel PNL.

In some embodiments, the first color light Ly may be a yellow color light and the second color light Lb may be a blue color light. When the first color light Ly is a yellow color light, the first color light Ly includes light having spectral bands corresponding to a red light component and a green light component. Specifically, the first color light Ly includes at least a spectral band corresponding to red color light and a spectral band corresponding to green color light.

Next, the red light component of the first color light Ly generated from the backlight unit BLU during the first sub-field 1-Field passes through the first color filter R and displays a red color, and the green light component of the first color light Ly passes through the second color filter G and displays a green color.

The second color light Lb generated from the backlight unit BLU during the second sub-field 2-Field passes through the open portion W and displays a blue color.

As described above, the open portion W provides a space in which the yellow color and the blue color is able to pass through during the first sub-field 1-Field and the second sub-field 2-Field, respectively. In addition, the open portion W can reduce the occurrence of color breakup during the time division scheme. The open portion W can also be adjusted to enhance image brightness or color. For example, the size of the open portion W can be adjusted to produce a transmittance corresponding to the desired brightness or desired color of the frame.

Figure 3A:
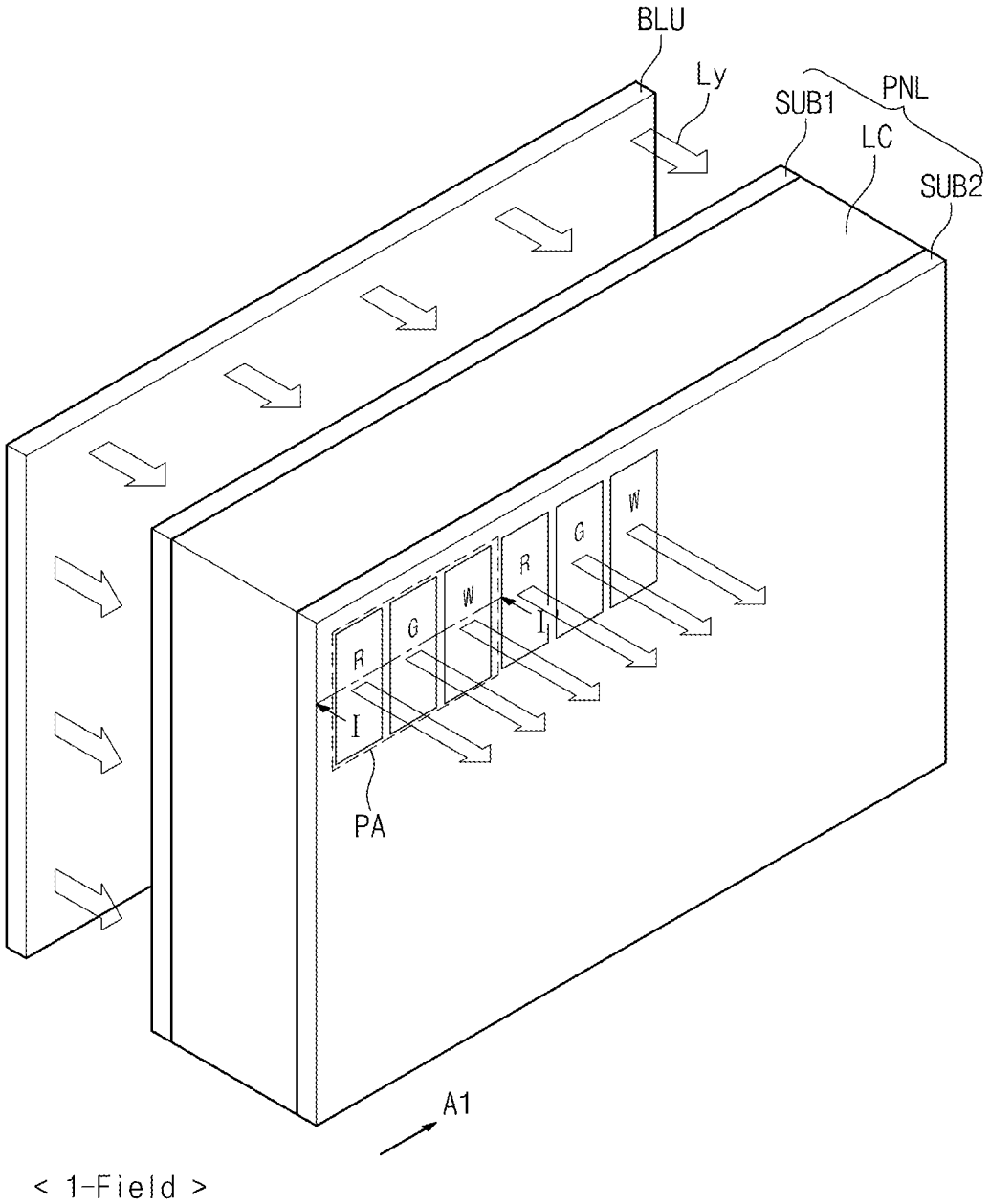
FIGS. 3A and 3B are perspective views illustrating an exemplary realization of a full color image using time and space division schemes.
Figure 3B:
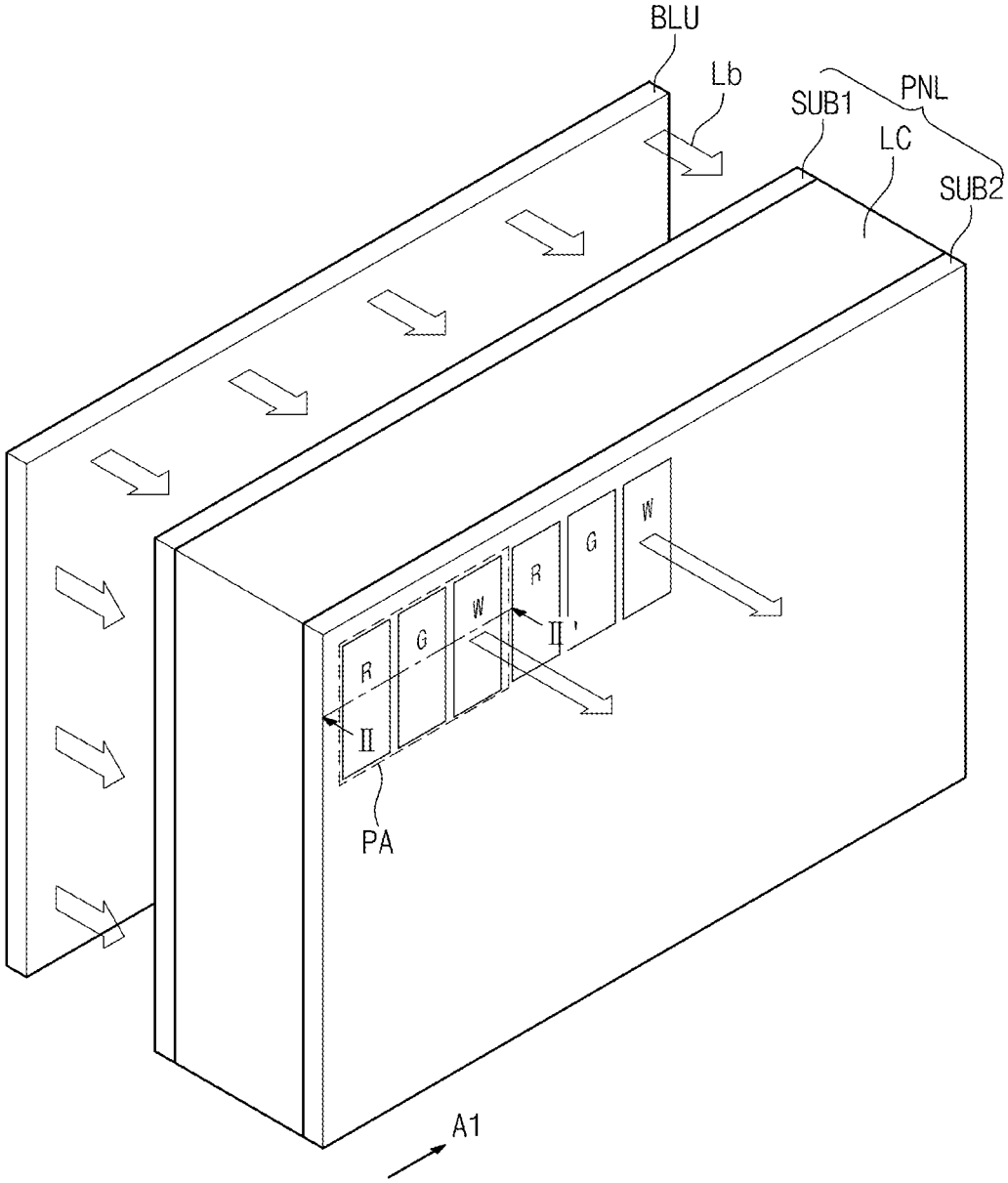
Figure 4:
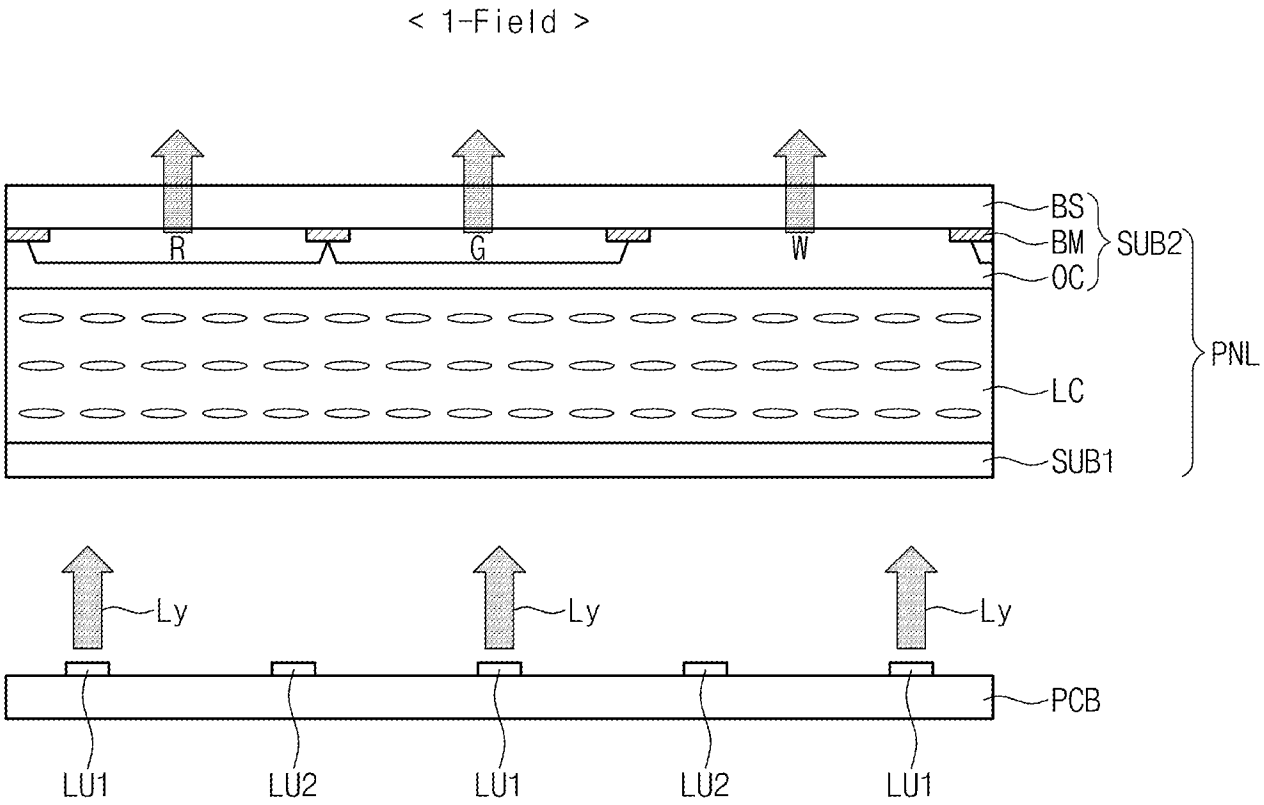
FIG. 4 is a cross-sectional view taken along line I-I' of FIG. 3A.
Figure 5:
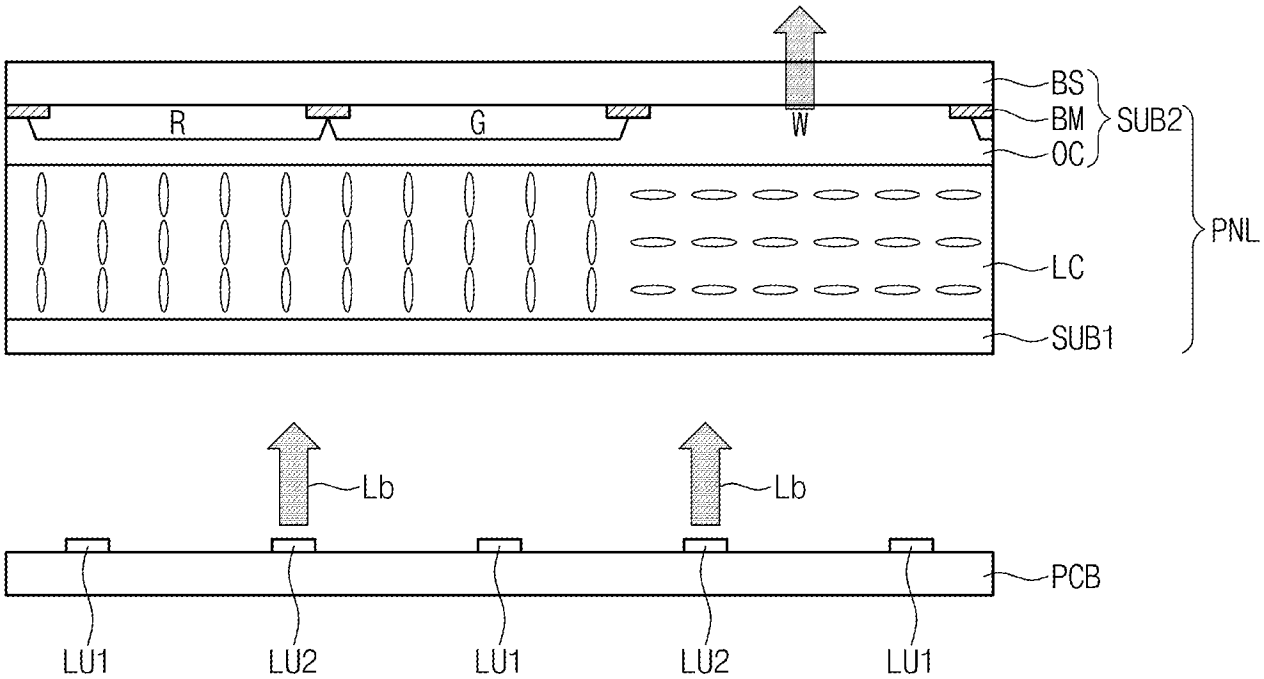
FIG. 5 is a cross-sectional view taken along line II-II' of FIG. 3B.

FIGS. 3A and 3B are perspective views illustrating an exemplary realization of a full color image using time and space division schemes. FIG. 4 is a cross-sectional view taken along line I-I' of FIG. 3A, and FIG. 5 is a cross-sectional view taken along line II-II' of FIG. 3B. Specifically, FIGS. 3A and 4 depict an operation mode of the first sub-field of the frame, and FIGS. 3B and 5 depict an operation mode of the second sub-field of the frame.

In an exemplary embodiment, an operation mode of the display panel PNL and the backlight unit BLU is changed every first and second sub-fields 1-Field and 2-Field. However, the structures of the display panel PNL and the backlight unit BLU remain unchanged. Accordingly, the structures of the display panel PNL and the backlight unit BLU will be described first.

Referring to FIG. 3A, the display panel PNL includes red and green color filters R and G repeatedly arranged in a first direction A1.

As shown in FIGS. 3A and 4, the display panel PNL includes a first substrate SUB1, a second substrate SUB2 substantially parallel to the first substrate SUB1, and a liquid crystal layer LC interposed between the first substrate SUB 1 and the second substrate SUB2.

In some embodiments, the first substrate SUB1 may be a lower substrate on which the thin film transistor Tr and a first electrode (e.g., a pixel electrode of the liquid crystal capacitor C1c) of each pixel PX (see FIG. 1) are disposed. The second substrate SUB2 may be an upper substrate on which the two color filters R and G (disposed in each pixel area PA corresponding to each pixel PX) and a second electrode (e.g., a common electrode of the liquid crystal capacitor C1c) are disposed.

Referring to FIG. 4, the second substrate SUB2 includes a base substrate BS, with red and green color filters R and G disposed on the base substrate BS, a black matrix BM disposed along an edge of the red and green color filters R and G, and an overcoating layer OC covering the red and green color filters R and G and the black matrix BM.

The open portion W is disposed on the base substrate BS adjacent to at least one side of the red and green color filters R and G.

The overcoating layer OC is formed of an organic insulating layer, and covers the red and green color filters R and G and the open portion W. The overcoating layer OC provides a planar surface by reducing a step difference between the areas where the color filters R and G and open portion W are disposed.

Referring to FIGS. 3A and 4, the backlight unit BLU includes the first light source LU1 and the second light source LU2 mounted on the printed circuit board PCB. In the example of FIG. 4, the first light source LU1 and the second light source LU2 are alternately arranged on the printed circuit board PCB. Nevertheless, the arrangement of the light sources is not limited to the configuration shown in FIG. 4. For example, the first light source LU1 and the second light source LU2 may be arranged in a variety of configurations.

The first light source LU1 emits the first color light Ly and the second light source LU2 emits the second color light Lb. During the first sub-field 1-Field, the first light source LU1 is driven to emit the first color light Ly while the second light source LU2 is turned off.

Each pixel includes a red sub-pixel corresponding to the red color filter R, a green sub-pixel corresponding to the green color filter G, and a white sub-pixel corresponding to the open portion W. The white sub-pixel transmits the light passing through the open portion W; however, the light transmitted by the white sub-pixel need not necessarily be of white color.

Each of the red, green, and white sub-pixels includes a thin film transistor and a liquid crystal capacitor operated independently of the other sub-pixels.

The red, green, and white sub-pixels are operated during the first sub-field 1-Field. Thus, the first color light Ly emitted from the first light source LU1 passes through the red and green color filters R and G and the open portion W, and is subsequently displayed as the image.

Referring to FIGS. 3B and 5, during the second sub-field 2-Field, the second light source LU2 is driven to emit the second color light Lb while the first light source LU1 is turned off. The liquid crystal layer corresponding to the red and green subpixels does not transmit light.

As a result, the red and green light are not able to pass through during the second sub-field 2-Field, whereas the white sub-pixel transmit light during the second sub-field 2-Field. Accordingly, the second color light Lb emitted from the second light source LU2 does not pass through the red and green color filters R and G but instead passes through the open portion W, thereby displaying the blue image.

By using the time/space division schemes described above, the display apparatus can realize a full color image with improved display quality and response speed, thereby reducing the occurrence of color breakup.

Figure 6:
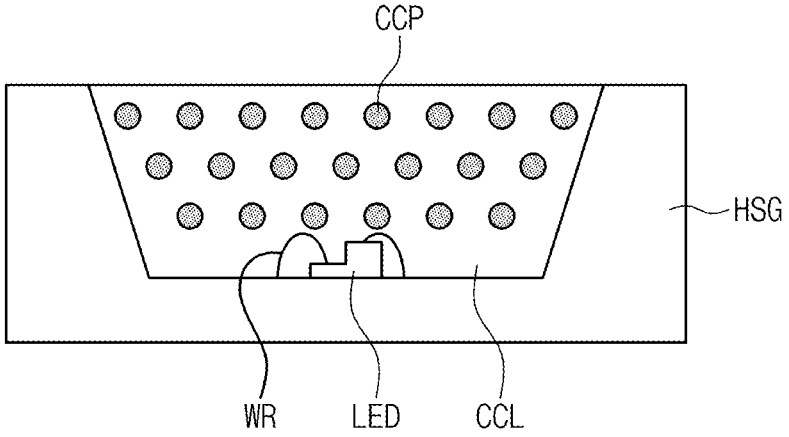
FIG. 6 is a cross-sectional view showing a first light source unit according to an exemplary embodiment of the present disclosure.

As mentioned previously, the first light source unit LU1 applies the first color light to the display panel PNL. FIG. 6 is a cross-sectional view showing the first light source unit according to an exemplary embodiment of the present disclosure.

Referring to FIG. 6, the first light source unit includes a first light source LED that emits light with a first spectral band, a photo-converter CCL that covers the first light source LED and converts the light to the first color light, and a housing HSG that accommodates the first light source LED and the photo-converter CCL.

The first light source LED emits the light and is accommodated in the housing HSG. The first light source LED may include a light emitting diode chip. In practice, the first light source unit LU1 may include any type of light source that is capable of emitting light with the first spectral band. In an exemplary embodiment, the first spectral band of the light emitted from the first light source LED corresponds to a spectral band representing blue color light.

The photo-converter CCL includes a photo-converting material CCP that absorbs light emitted from the first light source LED having the first spectral band and converts the light to the first color light (e.g., the yellow color light).

The photo-converting material CCP may include phosphor and/or quantum dots. Nevertheless, the photo-converting material CCP need not be limited to the above-described materials. For example, the photo-converting material CCP may include any type of material that is capable of absorbing light having a first spectral band and converting the light to a first color light. In the present embodiment, the photo-converting material CCP absorbs light having the first spectral band corresponding to blue color light, and converts the light having the first spectral band to light having the spectral band corresponding to yellow color light.

When the first color light perceived by a user is the yellow color light, the wavelength of the light can be mainly positioned in either: (1) the spectral band corresponding to the yellow color on a spectrum; or (2) the spectral band corresponding to the green and red colors on the spectrum. In the former case, a peak of the spectrum is positioned in the spectral band corresponding to the yellow color. In the latter case, a portion of the spectrum may be positioned in the spectral band corresponding to the green and red colors. Specifically in the latter case, the peak of the spectrum is positioned in the wavelength corresponding to the green and red colors, and a half-maximum-full-width is narrower than that of the former case. In the latter case, the first color light is perceived by the user as the yellow color light due to the mixing of the green color light and the red color light. According to the present exemplary embodiment, the yellow color light corresponds to the latter case, and thus the yellow color light has the spectral band corresponding to the green and red colors.

The light having the first spectral band corresponding to the blue color may easily excite the phosphor and/or the quantum dot because the light in the blue spectral band has a short wavelength. In an exemplary embodiment, the first spectral band ranges from about 435 nanometers to about 447 nanometers.

As shown in FIG. 6, the housing HSG provides a space therein to accommodate the first light source LED and the photo-converter CCL. In some embodiments, the housing HSG may have an opening on a side portion to emit light through the opening.

The first light source LED is connected to an external power supply (not shown) by a wire WR passing through the housing HSG.

In the present exemplary embodiment, the second light source unit includes a second light source that emits a light having a second spectral band, a cover portion that covers the second light source, and a housing that accommodates the second light source and the cover portion. Since the second light source unit has substantially the same structure as that of the first light source unit, detailed description of the same elements shall be omitted. Instead, the description shall focus on the difference between the first and second light source units. Unlike the first light source unit, the cover portion of the second light source unit is used to transmit light (instead of being used as a photo-converter). Since photo-converting material is not applied to the second light source unit, the cover portion of the second light source unit does not require a photo-converting function. Thus, the cover portion of the second light source unit is used to transmit the light emitted from the second light source.

The second light source emits the light and is accommodated in the housing. The second light source may include a light emitting diode chip or any type of light source that is capable of emitting the light with the second spectral band.

The second spectral band of the light corresponds to the spectral band representing the blue color from the first light source. However, the spectral band of the light emitted from the second light source is different from the spectral band of the light emitted from the first light source. For example, the second spectral band may be of a shorter (or longer) wavelength than the first spectral band. When the second spectral band is of a longer wavelength than the first spectral band, the observer perceives a high brightness of the light. In an exemplary embodiment, the wavelength of the light emitted from the second light source ranges from about 448 nanometers to about 460 nanometers.

Figure 7:
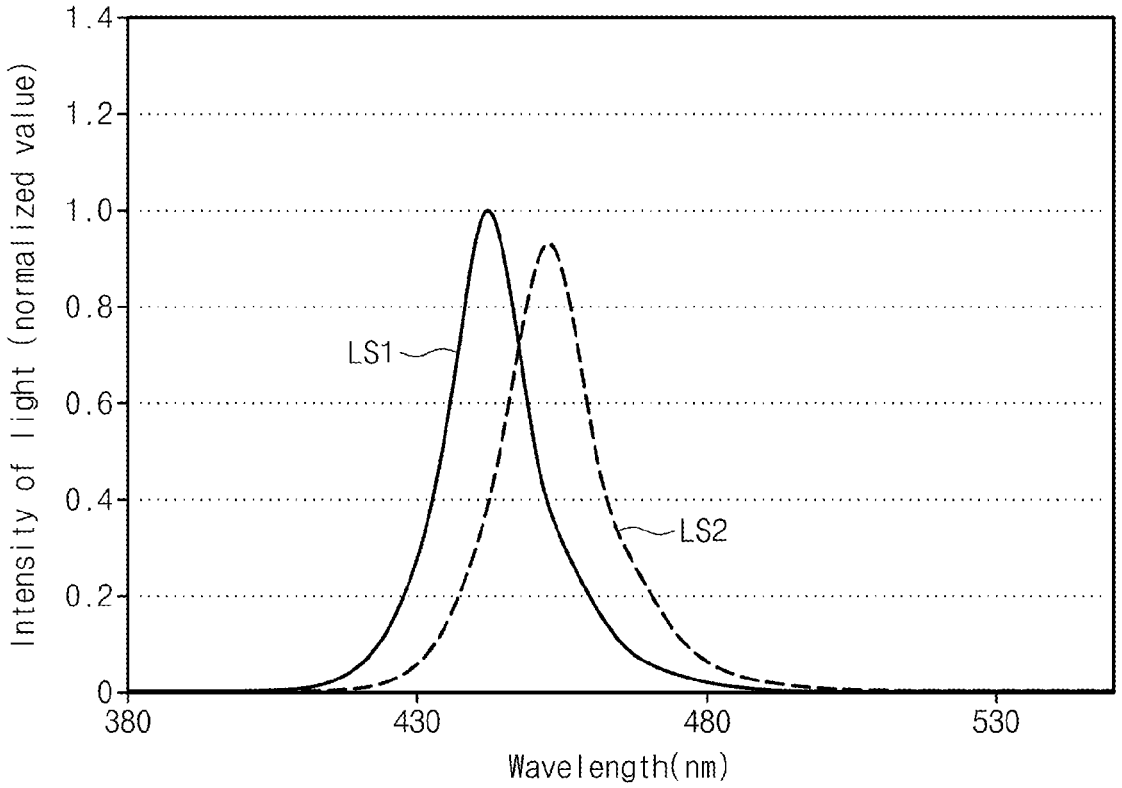
FIG. 7 is a graph showing a normalized spectrum of light emitted from first and second light sources according to an exemplary embodiment of the present disclosure.

FIG. 7 is a graph showing a normalized spectrum of the light emitted from the first and second light sources according to an exemplary embodiment of the present disclosure.

Referring to FIG. 7, the spectral band of the first light source LS1 is of a shorter wavelength than the spectral band of the second light source LS2, and therefore an intensity of the second light source LS2 is lower than an intensity of the first light source LS1.

Figure 8:
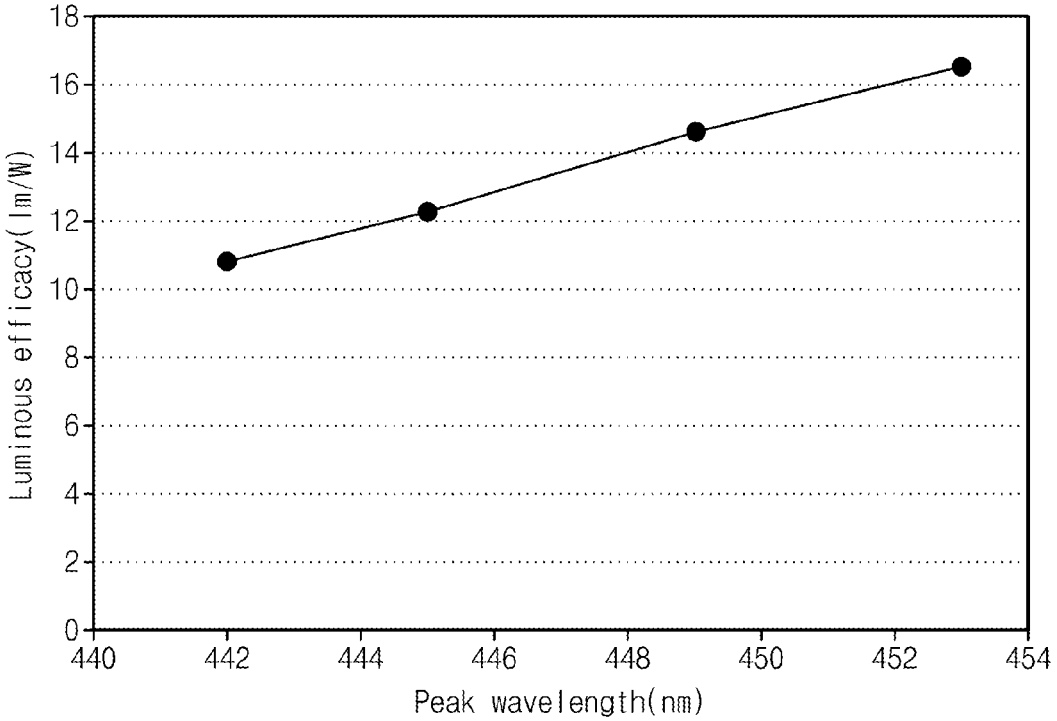
FIG. 8 is a graph showing a luminous efficacy of a second light source unit as a function of a wavelength of a blue light.

FIG. 8 is a graph showing a luminous efficacy of the second light source unit as a function of the wavelength of the blue color light.

Referring to FIG. 8, the luminous efficacy improves when the peak wavelength of the blue color light increases. In particular, the luminous efficacy improves by about 52% when the wavelength of the blue color light increases from about 454 nanometers to about 442 nanometers.

Referring to FIGS. 7 and 8, when the wavelength of the blue color light is increased, the photonic luminous function is improved despite the reduction in intensity of the blue color light. As a result, luminous intensity of the blue color light is enhanced when the wavelength of the blue color light is increased. For example, when the wavelength of the blue color light is increased about 10 nanometers, the luminous efficacy is improved by about 50%.

Thus, when the second light source emits the blue color light having the spectral band of about 448 nanometers to about 460 nanometers, power consumption of the backlight unit is reduced due to the increase in luminous efficacy. For example, when the second light source emits the blue color light having the spectral band of about 449 nanometers to about 453 nanometers, the power consumption of the exemplary backlight unit is reduced by about 14% compared to a conventional backlight unit.

It is noted that in a conventional backlight unit, the amount of the blue color light is typically less than that of the yellow color light. Subsequently, image defects may be caused by the non-uniformity between the amounts of blue light and yellow light. However, the image defects can be mitigated by improving the luminous efficacy of the blue color light (using the exemplary backlight unit in this disclosure).

Furthermore, when the second light source emits light having a spectral band of about 449 nanometers to about 453 nanometers (which is a relatively longer wavelength compared to the light produced by a conventional backlight unit), an accordance rate of a color area of the exemplary display apparatus with respect to sRGB color coordinate becomes higher than an accordance rate of a color area of a conventional display apparatus with respect to sRGB color coordinate.

Figure 9:
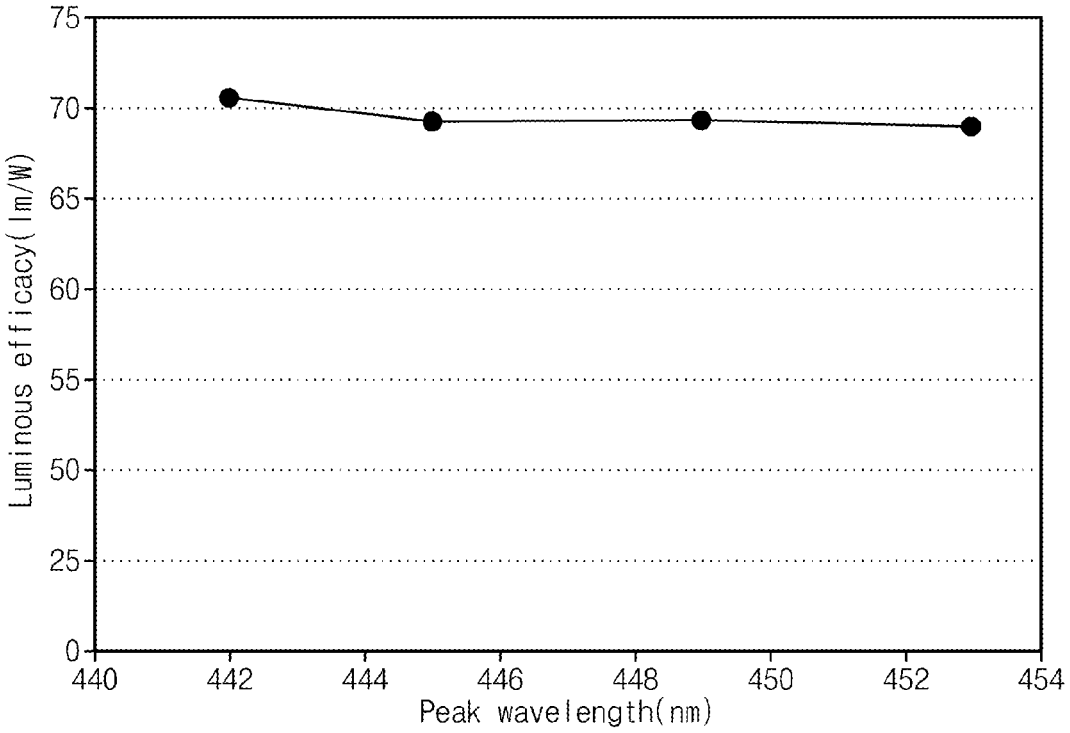
FIG. 9 is a graph showing a luminous efficacy of a first light source unit as a function of a wavelength of a blue light.
Figure 10:
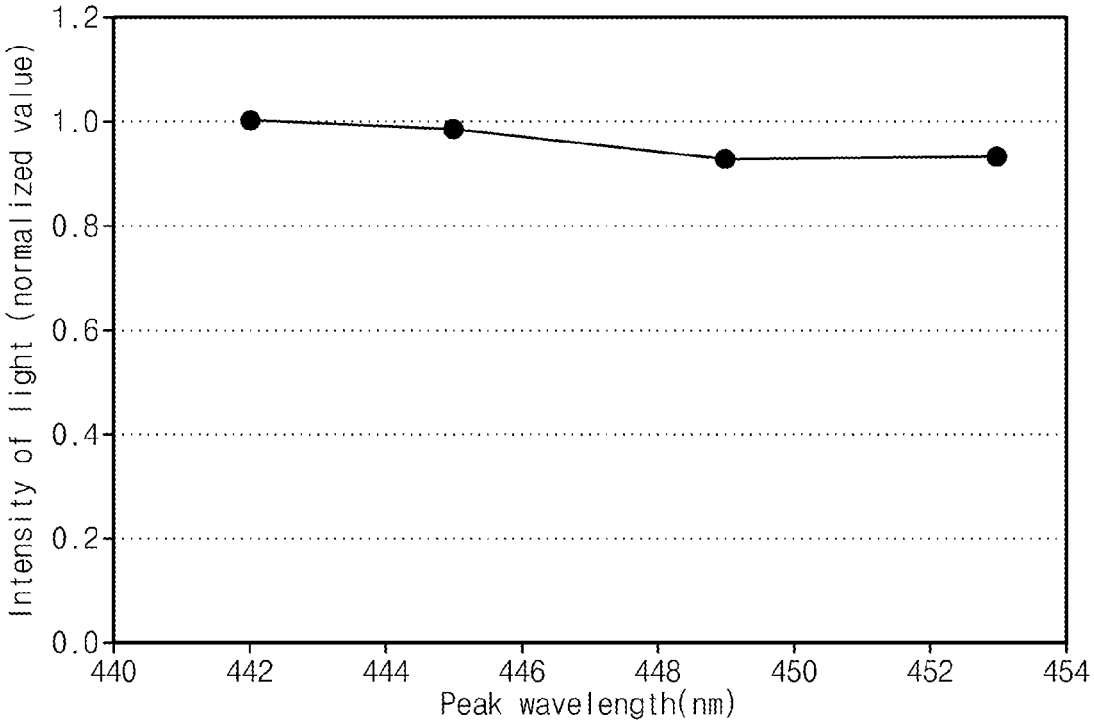
FIG. 10 is a graph showing a normalized intensity of a first light source unit as a function of a wavelength of a blue light.

FIG. 9 is a graph showing the luminous efficacy of the first light source unit as a function of the wavelength of the blue color light, and FIG. 10 is a graph showing a normalized intensity of the first light source unit as a function of the wavelength of the blue color light.

Referring to FIGS. 9 and 10, when the wavelength of the blue color light increases, the luminous efficacy and the intensity of the first light source unit are reduced. For example, the luminous efficacy of the first light source unit is reduced by about 4% when the wavelength of the blue color light is increased from about 442 nanometers to about 453 nanometers. Thus, the luminous efficacy of the yellow color light is reduced when the wavelength of the blue color light (that is used to excite the phosphor of the first light source unit) is increased. Accordingly, the wavelength of the blue color light of the first light source unit has a spectral band ranging from about 435 nanometers to about 447 nanometers, which is a shorter wavelength than the wavelength of the blue color light of the second light source unit.

The following table (Table 1) depicts the results obtained by varying the wavelength of the second light source when the wavelength of the first light source is fixed at about 442 nanometers.

TABLE 1

| Wavelength of first light source | Wavelength of second light source | Measured brightness | Color coordinate (CIE x, y) | | Power consumption (measured value) | Rate of change in power consumption | Gamut to NTSC | sRGB accordance rate |
|---|---|---|---|---|---|---|---|---|
| nm | nm | Cd/m$^2$ | x | y | Watt | % | % | % |
| 442 | 442 | 699.6 | 0.287 | 0.279 | 71.8 | — | 75.4 | 91.3 |
| 442 | 449 | 701.0 | 0.277 | 0.274 | 61.6 | −14.3 | 79.2 | 93.1 |
| 442 | 453 | 699.5 | 0.271 | 0.272 | 63.0 | −12.3 | 79.2 | 93.9 |

Referring to Table 1, although there is no substantial difference between the measured brightness when the wavelength of the blue color light emitted from the second light source is longer than the wavelength of the blue color light emitted from the first light source, power consumption is nonetheless reduced when the wavelength of the blue color light emitted from the second light source is increased. For example, the rate of change in power consumption decreases by about 14.3% and 12.3% when the wavelength of the blue color light emitted from the second light source is increased to about 449 nanometers and 453 nanometers, respectively.

In addition, when the wavelength of the blue color light emitted from the second light source is longer than the wavelength of the blue color light emitted from the first light source, the gamut to NTSC is improved to about 79% and the accordance rate with respect to the sRGB is improved to about 93%. Accordingly, when the wavelength of the blue color light of the first light source is different from the wavelength of the blue color light of the second light source (particularly when the spectral band of the blue color light of the second light source is of a longer wavelength than that of the first light source), the power consumption of the display apparatus is reduced and the color reproducibility of the image is improved.

Although certain exemplary embodiments of the present inventive concept have been described, it is understood that the inventive concept is not limited to the described embodiments. Instead, various changes and modifications can be made by one of ordinary skill in the art within the spirit and scope of the present disclosure.

What is claimed is:

1. A display apparatus comprising:

a display panel configured to display an image in a unit of frame and including a plurality of pixels, each of the plurality of pixels essentially consisting of first, second and third sub-pixels respectively corresponding to a first color filter, a second color filter, and an open portion having no color filter, wherein the frame is divided into a first sub-field and a second sub-field timely separated from the first sub-field;

a first light source unit disposed at a rear surface of the display panel to provide a first color light to the display panel during the first sub-field;

a second light source unit disposed at the rear surface of the display panel to provide a second color light to the display panel during the second sub-field; and a controller configured to turn-on the first light source unit and turned off the second light source unit during the first sub-field, and turn-on the second light source unit and turned off the first light source unit during the second sub-field, wherein the first light source unit comprises a first light source that emits light having a first spectral band and a photo-converter that converts the light having the first spectral band to the first color light, and a spectral band of the first color light is different from the first spectral band of the light, wherein the second light source unit comprises a second light source that emits light having a second spectral band, the light having the second spectral band corresponds to the second color light, and a spectral band of the second color light is different from the spectral band of the first color light, wherein the first spectral band and the second spectral band belong to a blue spectral band of light having substantially blue color, wherein the first spectral band has a first peak wave length and the second spectral band has a second peak wave length which is different from that of the first spectral band, and wherein the first color filter, the second color filter and the opening portion transmit the first color light during the first sub-field, the opening portion transmits the second color light during the second sub-field, and the first color filter and the second color filter do not transmit the second color light during the second sub-field.

2. The display apparatus of claim 1, wherein the first, second, and third sub-pixels are independently driven.

3. The display apparatus of claim 2, wherein the first, second, and third sub-pixels receive the first color light during the first sub-field to display the image, and the third sub-pixel receives the second color light during the second sub-field to display a blue image.

4. The display apparatus of claim 3, wherein the first color light includes a yellow color light.

5. The display apparatus of claim 3, wherein the first and second color filters respectively comprise a red color filter and a green color filter.

6. The display apparatus of claim 1, wherein the photo-converter includes a phosphor or a quantum dot to absorb the light from the first light source and emit the first color light.

7. The display apparatus of claim 6, wherein the photo-converter receives the light from the first light source and emits a light having a yellow color spectral band.

8. The display apparatus of claim 6, wherein the photo-converter receives the light from the first light source and emits a light having a red color spectral band and a light having a green color spectral band.

9. The display apparatus of claim 1, wherein the first spectral band of the light emitted from the first light source is of a shorter wavelength than the second spectral band of the light emitted from the second light source.

10. The display apparatus of claim 9, wherein the first spectral band of the light emitted from the first light source ranges from about 435 nanometers to about 447 nanometers, and the second spectral band of the light emitted from the second light source ranges from about 448 nanometers to about 460 nanometers.

* * * * *